US007611814B2

(12) United States Patent
Sensui

(10) Patent No.: US 7,611,814 B2
(45) Date of Patent: Nov. 3, 2009

(54) POLYMERIZED TONER HAVING LOW-TEMPERATURE FIXING ABILITY

(75) Inventor: Keita Sensui, Tokyo (JP)

(73) Assignee: Zeon Corporation, Tokyo (JP)

( * ) Notice: Subject to any disclaimer, the term of this patent is extended or adjusted under 35 U.S.C. 154(b) by 368 days.

(21) Appl. No.: 11/236,554

(22) Filed: Sep. 28, 2005

(65) Prior Publication Data

US 2006/0073402 A1 Apr. 6, 2006

(30) Foreign Application Priority Data

Sep. 29, 2004 (JP) ..... 2004-284846

(51) Int. Cl.
*G03G 9/093* (2006.01)

(52) U.S. Cl. ..... 430/108.4; 430/109.4; 430/110.2

(58) Field of Classification Search ..... 430/108.4, 430/109.3, 110.2
See application file for complete search history.

(56) References Cited

U.S. PATENT DOCUMENTS

| | | | | |
|---|---|---|---|---|
| 6,132,919 | A | 10/2000 | Ogawa et al. | |
| 6,713,221 | B2 * | 3/2004 | Kada et al. | 430/108.4 |
| 6,841,325 | B2 * | 1/2005 | Ueda et al. | 430/108.4 |
| 2004/0067429 | A1 * | 4/2004 | Ueda et al. | 430/108.4 |

FOREIGN PATENT DOCUMENTS

| | | | |
|---|---|---|---|
| JP | 10-282822 | A | 10/1998 |
| JP | 2001-147550 | A | 5/2001 |
| JP | 2004251932 | A * | 9/2004 |

OTHER PUBLICATIONS

Diamond, Arthur S & David Weiss (eds.) Handbook of Imaging Materials, 2nd ed.. New York: Marcel-Dekker, Inc. (Nov. 2001) pp. 182, 183, and 187-189.*

* cited by examiner

*Primary Examiner*—Christopher RoDee
(74) *Attorney, Agent, or Firm*—Birch, Stewart, Kolasch & Birch, LLP

(57) ABSTRACT

An object of the present invention is to provide a polymerized toner which has low-temperature fixing ability and is not likely to leak the toner from a developing cartridge, especially, when the toner is used for a high-speed image-forming device.

A polymerized toner produced by polymerizing a polymerizable monomer composition comprising a polymerizable monomer, a colorant and a release agent in an aqueous medium is used, wherein:

(1) the release agent is an ester compound;

(2) the release agent is in the content from 1 part by weight or more to 9 parts by weight or less per 100 parts by weight of a monovinyl monomer in the polymerizable monomer;

(3) a maximum endothermic peak temperature in a DSC curve of the release agent is in the range from 55° C. or more to 90° C. or less; and (4) a melt index value of the polymerized toner at 150° C. under load of 98 N (10 kgf) is in the range from 1 g/10 min or more to 30 g/10 min or less.

6 Claims, No Drawings

POLYMERIZED TONER HAVING LOW-TEMPERATURE FIXING ABILITY

BACKGROUND OF THE INVENTION

1. Field of the Invention

The present invention relates to a polymerized toner used for development in copying machines, facsimile machines, laser printers or the like by electrophotography.

2. Description of the Related Art

Recently, image-forming devices such as copying machines, printers or the like by electrophotography have been of very wide prevalence in offices or the like. Also, meeting the needs of colorization of such a device has been proceeded lately. Particularly, higher resolution and higher printing speed are required for office use, thus, a toner to meet the requirement is needed.

In order to attain higher resolution, a method to obtain a toner having high transferability and high dot reproducibility using a spherical toner (polymerized toner) by various polymerization methods is suggested. Herein, the polymerized toner means a toner for developing an electrostatic latent image produced by various polymerization methods.

Also, in order to achieve higher speed, it is required for a toner to be able to fix at lower fixing temperature (low-temperature fixing ability), thus, various methods are proposed.

Japanese Patent Application Laid-Open (JP-A) No. Hei. 10-282822 discloses an image-forming method using a toner which contains 5 to 40 parts by weight of a low-softening point substance as a release agent of the polymerized toner, has a specific range of physical property of a THF insoluble content of the toner and has a melt index value from 0.5 to 15 g/10 min at 125° C. under load of 49.0 N (5 kgf).

Also, JP-A No. 2001-147550 discloses a toner which contains a multifunctional ester compound, which has 5 or more ester bonds in a molecule, has a molecular weight from 2,000 or more, dissolves to 100 g of styrene by 5 g or more at 35° C., and has an acid value of 2 mgKOH/g or less, as a release agent.

WO1998/20396 corresponding to U.S. Pat. No. 6,132,919 discloses a polymerized toner having a core-shell type structure in which a core particle, comprising a colored polymer particle containing a multifunctional ester compound composed of polyalcohol of trifunctional or more and carboxylic acid as a release agent and a colorant, is covered with a shell layer.

The methods disclosed in the above-mentioned publications improve low-temperature fixing ability in certain degree, however, a new problem is caused wherein a toner easily leaks from a developing cartridge. If the toner leaks, the leaked toner scatters in a developing apparatus leading to problems such as spoiling a printed product, and annoying users with the toner smudging their hands when changing a developing cartridge.

SUMMARY OF THE INVENTION

An object of the present invention is to provide a polymerized toner which has low-temperature fixing ability and is not likely to leak the toner from a developing cartridge, especially, when the toner is used for a high-speed image-forming device.

Generally, a sealing member is furnished to prevent a toner from leaking from between both ends of a developing roller in an axial direction and a body of a developing cartridge. However, using a polymerized toner, the effect of the sealing member may not be sufficient since the polymerized toner has a spherical form and the toner easily gets through between the sealing member and the developing roller.

In a study done by the inventor of the present invention, it was particularly found that in the case of the polymerized toner excellent in low-temperature fixing ability as disclosed in the publications, the toner which gets through between the sealing member and the developing roller is easily melted due to the friction lead from sliding caused by a rotary driving of the developing roller and adheres to the developing roller when the developing roller is halted and the toner is cooled.

Also, the inventor of the present invention found that the adhered toner scrapes the developing roller or the sealing member at the time of driving and rotating the developing roller thereafter so that the toner leaks from between the sealing member and the developing roller to the outside of the developing cartridge.

In a study done by the inventor of the present invention, it was found that the problem of the toner leakage can be solved by using an ester compound having an endothermic peak temperature in a specific range as a release agent for an added amount of a specific range, and delimiting a melt index of a polymerized toner in a specific range.

According to the present invention, a polymerized toner which can attain high resolution and maintain excellent low-temperature fixing ability, and is less likely to leak a toner from a developing cartridge can be obtained when a polymerized toner produced by polymerizing a polymerizable monomer composition comprising a polymerizable monomer, a colorant and a release agent in an aqueous medium, is in such a condition that:

(1) the release agent is an ester compound;

(2) the release agent is in the content from 1 part by weight or more to 9 parts by weight or less per 100 parts by weight of a monovinyl monomer in the polymerizable monomer;

(3) a maximum endothermic peak temperature in a DSC curve of the release agent is in the range from 55° C. or more to 90° C. or less; and (4) a melt index value of the polymerized toner at 150° C. under load of 98 N (10 kgf) is in the range from 1 g/10 min or more to 30 g/10 min or less.

Also, in present invention, it is preferable that the added amount of the ester compound is from 2 parts by weight or more to 7 parts by weight or less per 100 parts by weight of a monovinyl monomer, the maximum endothermic peak temperature in a DSC curve is in the range from 60° C. or more to 80° C. or less, or the molecular weight is 500 or more and 1,900 or less. It is more preferable that the melt index value of the polymerized toner is in the range from 2 g/10 min or more to 20 g/10 min or less.

Further, in the present invention, it is more preferable that the ester compound is ester of alcohol of trivalent or more and fatty acid having carbons in the number from 12 or more to 22 or less.

According to the present invention, a polymerized toner which is excellent in low-temperature fixing ability and is not likely to leak a toner from a developing cartridge when the toner is used for a high-speed image-forming device is provided.

DETAILED DESCRIPTION OF THE INVENTION

Hereinafter, a polymerized toner and a method for producing the same of the present invention will be explained.

The polymerized toner of the present invention is produced as follows. Firstly, a polymerizable monomer composition is obtained by mixing a polymerizable monomer, a colorant, an ester compound as a release agent, and further, if required, other additives. The polymerizable monomer composition is charged with an aqueous medium, thereto a polymerization initiator is added. After forming droplets of the polymerizable monomer composition, polymerization is performed, thereby, an aqueous dispersion of a colored polymer particle is obtained. The aqueous dispersion is washed, dewatered, dried and, if required, classified. Further, an external additive and/or a career may be added when needed. Thereby, the polymerized toner is obtained.

(1) Polymerizable Monomer Composition

The polymerizable monomer of the present invention means a polymerizable compound.

In the present invention, as a major component of the polymerizable monomer, a monovinyl monomer may be used. As the monovinyl monomer, for example, there may be styrene; a styrene derivative such as vinyl toluene, α-methyl styrene or the like; acrylic acid; methacrylic acid; acrylic acid ester such as methyl acrylate, ethyl acrylate, propyl acrylate, butyl acrylate, 2-ethylhexyl acrylate, dimethylaminoethyl acrylate or the like; methacrylic acid ester such as methyl methacrylate, ethyl methacrylate, propyl methacrylate, butyl methacrylate, 2-ethylhexyl methacrylate, dimethylaminoethyl methacrylate or the like; an unsaturated nitrile compound such as acrylonitrile, methacrylonitrile; an unsaturated amide compound such as acrylamide, methacrylamide or the like; olefin such as ethylene, propylene, butylene or the like; a nitrogen-containing vinyl compound such as 2-vinylpyridine, 4-vinylpyridine, N-vinylpyrrolidone or the like. The monovinyl monomer may be used alone or in combination of more than one monomer. Among the above, styrene, the styrene derivative, acrylic acid ester, and methacrylic acid ester may be suitably used as the monovinyl monomer.

It is preferable that the monovinyl monomer is selected so that a glass transition temperature (hereinafter, it is represented by Tg) of a polymer to be obtained by polymerizing the monovinyl monomer is 80° C. or less. The monovinyl monomer may be used alone or in combination of two or more kinds. Thereby, Tg of the polymer to be obtained can be adjusted in a desired range.

In order to prevent hot offset, any crosslinkable polymerizable monomer may be preferably used as a sub-component of the polymerizable monomer together with the monovinyl monomer. The crosslinkable polymerizable monomer means a monomer having two or more polymerizable functional groups. As the crosslinkable polymerizable monomer, for example, there may be an aromatic divinyl compound such as divinyl benzene, divinyl naphthalene, a derivative thereof or the like; a diacrylate compound and a derivative thereof such as ethylene glycol dimethacrylate, diethylene glycol dimethacrylate or the like; other divinyl compound such as N,N-divinyl aniline, divinyl ether or the like; a compound having three or more vinyl groups; or the like. The crosslinkable polymerizable monomer may be used alone or in combination of two or more kinds.

In the present invention, 0.1 to 5 parts by weight of the crosslinkable polymerizable monomer with respect to a monovinyl monomer of 100 parts by weight may be generally used, preferably 0.3 to 2 parts by weight, more preferably 0.5 to 1.5 parts by weight.

Further, it is preferable to use a macromonomer as a sub-component of the polymerizable monomer since a balance between prevention of blocking at storage and lowering of fixing temperature of a polymerized toner to be obtained improves. The macromonomer is a monomer having a polymerizable carbon-carbon unsaturated double bond at the end of a molecular chain, which is a reactive oligomer or polymer generally having a number average molecular weight from 1,000 to 30,000.

As the macromonomer, a macromonomer which forms a polymer having higher Tg when polymerized than that of a polymer obtained by polymerizing the monovinyl monomer alone, which is a major component of the polymerizable monomer, is preferable. The amount of the macromonomer may be generally 0.01 to 10 parts by weight, preferably 0.03 to 5 parts by weight, more preferably 0.1 to 3 parts by weight, with respect to a monovinyl monomer of 100 parts by weight.

In the present invention, as a release agent, an ester compound composed of the following alcohol and carboxylic acid may be used.

As the carboxylic acid, for example, there may be aliphatic carboxylic acid such as undecanoic acid, lauric acid, myristic acid, stearic acid, behenic acid, margaric acid, arachidic acid, cerotic acid, melissic acid, erucic acid, brassidic acid, sorbic acid, linoleic acid, linolenic acid, tetrolic acid, ximenynic acid or the like; alicyclic carboxylic acid such as cyclohexane carboxylic acid, hexahydroisophthalic acid, hexahydroterephthalic acid, 3,4,5,6-tetrahydrophthalic acid or the like; aromatic carboxylic acid such as benzoic acid, toluic acid, cuminic acid, phthalic acid, isophthalic acid, terephthalic acid, trimesic acid, trimellitic acid, hemimellitic acid or the like; or the like. Among the above, carboxylic acid having 10 to 30 carbon atoms, preferably 13 to 25 carbon atoms, may be suitably used. Aliphatic carboxylic acid having 10 to 30 carbon atoms, preferably 13 to 25 carbon atoms, may be more suitably used. Further, particularly stearic acid and myristic acid may be suitably used.

As the alcohol, for example, there may be aliphatic monovalent alcohol such as methyl alcohol, ethyl alcohol, propyl alcohol, butyl alcohol, amyl alcohol, caproyl alcohol, caprylyl alcohol, caprylic alcohol, lauryl alcohol, myristyl alcohol, cetyl alcohol, stearyl alcohol, arachdic alcohol, behenyl alcohol, carnabil alcohol, seryl alcohol, coliyanyl alcohol, myricyl alcohol, mericyl alcohol, lacceril alcohol, allyl alcohol, crotyl alcohol, 2-butene-1-ol, 2-pentene-1-ol, 3-hexene-1-ol, 2-heptene-1-ol, 10-undecene-1-ol, 11-dodecene-1-ol, 12-tridecene-1-ol, oleyl alcohol, elaidyl alcohol, linoleyl alcohol, linolenyl alcohol or the like; aliphatic divalent alcohol such as ethylene glycol, propylene glycol, trimethylene glycol, 1,3-butanediol, 1,4-butanediol, 2,3-butanediol, 2-butene-1,4-diol, 1,5-pentanediol, 2,4-pentanediol, 1,6-hexanediol, 2,5-hexanediol, 2-methyl-1,3-pentanediol, 2,4-heptanediol, 2-ethyl-1,3-hexanediol, 2-ethyl-2-butyl-1,3-propanediol, 1,2-hexadecanediol, 1,2-octadecanediol, 1,2-eicosanediol, 1,2-docosanediol, 1,2-tetracosanediol or the like; a dehydration condensate of an aliphatic divalent alcohol such as diethylene glycol, triethylene glycol, tetraethylene glycol, dipropylene glycol or the like; aliphatic polyalcohol such as glycerol, pentaerythritol, sorbitol or the like; a dehydration condensate of aliphatic polyalcohol such as diglycerol, triglycerol, tetraglycerol, pentaglycerol, hexaglycerol, heptaglycerol, octaglycerol, nonaglycerol, decaglycerol, pentadecaglycerol, eicosaglycerol, triacontaglycerol, dipentaerythritol or the like; saccharide such as D-erythrose, arabinose, D-xylose, α-D-xylose, 2-deoxy-D-ribose, α-D-lyxose, D-ribulose, D-arabitol, ribitol, β-D-altrose, β-D-allose, α-D-galactose, β-D-galactose, α-L-galactose, α-D-quinovose, α-D-glucose, β-D-glucose, L-sorbose, D-tagatose, α-D-talose, D-fucose, α-D-fucose, α-L-fucose, D-psicose, D-fructose, D-mannose, α-D-mannose, α-L-rhamnose, D-inositol, myo-inositol, galactitol, D-glycitol, D-mannitol, D-altro-heptulose, D-manno-heptulose, D-altro-3-heptulose, D-glycero-D-galacto-heptyltol, D-galacto-D-galacto-octitol, D-glycero-D-manno-ocuturose, D-erythro-L-gulo-nonulose, agarobiose, α-gentiorose, sucrose, β-cellobiose, β-maltose, α-lactose, raffinose, α-cyclodextrin, β-cyclodextrin or the like, or a dehydration condensate thereof. Among the above, aliphatic alcohol and the dehydration condensate thereof may be preferable, more preferably aliphatic multivalent alcohol and the dehydration condensate thereof. Further, the alcohol having 10 or less carbons and 3 or more to 6 or less valences may be preferable.

As for alcohol and carboxylic acid comprising the ester compound of the present invention, it is preferable that if one of alcohol and carboxylic acid is low in molecular weight, the other is high in molecular weight.

As the ester compound, ester of alcohol of trivalent or more and fatty acid having 12 or more and 22 or less carbons is preferable. For example, particularly, pentaerythritol ester such as pentaerythritol tetramyristate, pentaerythritol tetrapalmitate, pentaerythritol tetrastearate, pentaerythritol tetralaurate or the like; dipentaerythritol ester such as dipentaerythritol hexamyristate, dipentaerythritol hexapalmitate, dipentaerythritol hexalaurate or the like may be suitably used since polymerization stability, blocking resistance at storage of a polymerized toner, low-temperature fixing ability are excellent. The above ester compound may be used alone or in combination of two or more kinds.

The ester compound of the present invention has a maximum endothermic peak temperature of 55 to 90° C., preferably 60 to 80° C. Herein, a temperature which shows a maximum endothermic peak (maximum endothermic peak temperature) is measured by means of a Differential Scanning Calorimetry (DSC) with reference to ASTM D3418-82 from DSC curve when heated at a heating rate of 10° C./min. Also, it is preferable that a molecular weight of the ester compound is 500 or more and 1,900 or less. By using the ester compound having the maximum endothermic peak temperature and the molecular weight in the above range, a toner is less likely to leak and a polymerized toner excellent in low-temperature fixing ability can be obtained.

1 part by weight or more and 9 parts by weight or less of the ester compound with respect to a monovinyl monomer of 100 parts by weight may be used, preferably 2 parts by weight or more and 7 parts by weight or less, more preferably 2.5 parts by weight or more and 6.5 parts by weight or less. By using the ester compound in the range, a toner is less likely to leak while excellent low-temperature fixing ability is maintained.

In the present invention, a colorant is used. Colorants of black, cyan, yellow and magenta may be generally used.

Among the colorants of the present invention, as the black colorant, a colorant such as carbon black, titanium black, magnetic powder including zinc iron oxide, nickel iron oxide or the like may be used.

As the cyan colorant, copper phthalocyanine, a derivative thereof, an anthraquinone compound or the like may be used. Specifically, there may be C. I. Pigment Blue 2, 3, 6, 15, 15:1, 15:2, 15:3, 15:4, 16 or the like. Since tinting strength is sufficient and stability upon polymerizing the polymerizable monomer is excellent, copper phthalocyanine such as C. I. Pigment Blue 15, 15:1, 15:2, 15:3, 15:4 or the like is preferable, more preferably C. I. Pigment Blue 15:3.

As the yellow colorant, for example, a compound such as an azo based pigment such as a monoazo pigment, a disazo pigment or the like, a condensation polycyclic pigment or the like may be used. Specifically, there may be C. I. Pigment Yellow 3, 12, 13, 14, 15, 17, 62, 65, 73, 74, 83, 93, 97, 120, 138, 155, 180, 181, 185, 186 or the like. Since tinting strength is sufficient and stability upon polymerizing the polymerizable monomer is excellent, the monoazo pigment such as C. I. Pigment Yellow 3, 15, 65, 73, 74, 97, 120 or the like is more preferable.

As the magenta colorant, for example, a compound such as an azo based pigment such as a monoazo pigment, a disazo pigment or the like, a condensation polycyclic pigment or the like may be used. Specifically, there may be C. I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, 251, C. I. Pigment Violet 19 or the like. Since tinting strength is sufficient and stability upon polymerizing the polymerizable monomer is excellent, the monoazo pigment such as C. I. Pigment Red 31, 48, 57:1, 58, 60, 63, 64, 68, 112, 114, 146, 150, 163, 170, 185, 187, 206, 207 or the like is similarly preferable.

An amount of the colorant is preferably 1 to 10 parts by weight with respect to a monovinyl monomer of 100 parts by weight.

As other additives, a charge control agent may be preferably used. Various kinds of charge control agents having positively charging ability or negatively charging ability may be used. For example, there may be used a charge control agent which is not a resin such as a metallic complex of an organic compound, a metal-containing dye, a nigrosine dye or the like which has a carboxyl group or a nitrogen-containing group; a charge control resin such as a quaternary ammonium group-containing copolymer, a copolymer containing a group of a quaternary ammonium salt, a sulfonic acid group-containing copolymer, a copolymer containing a group of a sulfonic acid salt, a carboxylic acid group-containing copolymer, a copolymer containing a group of a carboxylic acid salt or the like; or the like may be used.

It is preferable that the charge control agent contains the charge control resin since a printing durability of a polymerized toner improves. Among the charge control agent, the charge control agent which is not a resin and the charge control resin may be used in combination, or the charge control resin may be used alone. Using the charge control resin alone may be more preferable. Using the quaternary ammonium group-containing copolymer, the copolymer containing a group of a quaternary ammonium salt, the sulfonic acid group-containing copolymer or the copolymer containing a group of a sulfonic acid salt as the charge control resin may be most preferable.

0.01 to 10 parts by weight of the charge control agent with respect to a monovinyl monomer of 100 parts by weight may be generally used, preferably 0.03 to 8 parts by weight.

Further, as other additives, a molecular weight modifier may be preferably used. As the molecular weight modifier, there may be a mercapto compound such as t-dodecyl mercaptan, n-dodecyl mercaptan, n-octyl mercaptan, 2,2,4,6,6-pentamethylheptane-4-thiol or the like. The molecular weight modifier can be added prior to initiating polymerization or during polymerization. The amount of the molecular weight modifier may be 0.01 to 10 parts by weight with respect to a monovinyl monomer of 100 parts by weight, preferably 0.1 to 5 parts by weight, more preferably 0.3 to 3 parts by weight.

(2) Forming Droplets (of a Polymerizable Monomer Composition)

In the present invention, after dispersing the thus obtained polymerizable monomer composition in an aqueous medium containing a dispersion stabilizer and adding a polymerization initiator, the polymerizable monomer composition is formed as droplets. A method of forming droplets may not be particularly limited. For example, a device capable of strong agitation such as an in-line type emulsifying and dispersing machine (trade name: Ebara MILDER; manufactured by Ebara Corporation), a high-speed emulsifying and dispersing machine (trade name: T.K. homomixer MARK II type; manufactured by TOKUSHUKIKA KOGYO CO., LTD.) or the like may be suitably used.

In the present invention, the aqueous medium may be water alone, or a water-soluble solvent may be used together. As the water-soluble solvent, there may be lower alcohol such as methanol, isopropanol, ethylene glycol or the like; dimethylformamide; tetrahydrofuran; lower ketone such as acetone, methylethyl ketone or the like.

In the present invention, it is preferable that the dispersion stabilizer is contained in the aqueous medium from the viewpoint of stable dispersion of droplet of the polymerizable monomer composition in an aqueous medium or a colored polymer particle obtained by polymerization thereof, and obtaining a colored polymer particle having a narrow range of distribution of particle size. As the dispersion stabilizer, for example, there may be an inorganic compound such as sulfate including barium sulfate, calcium sulfate or the like; carbonate including barium carbonate, calcium carbonate, magnesium carbonate or the like; phosphate including calcium phosphate or the like; metal oxide including aluminum oxide, titanium oxide or the like; metal hydroxide including aluminum hydroxide, magnesium hydroxide, ferric hydroxide or the like; or the like, or an organic compound such as a water-soluble polymer such as polyvinyl alcohol, methyl cellulose, gelatin or the like; an anionic surfactant; a nonionic surfactant; an ampholytic surfactant; or the like. The dispersion stabilizer may be used alone or in combination of two or more kinds.

Among the dispersion stabilizer, the dispersion stabilizer containing a colloid of an inorganic compound, particularly hardly water-soluble metal hydroxide, is preferable since a particle size distribution of a colored polymer particle can be narrowed, and a residual amount of the dispersion stabilizer after washing is small so that a polymerized toner to be obtained can sharply reproduce an image and an environmental stability may not be decreased.

As the polymerization initiator, for example, there may be persulfate such as potassium persulfate, ammonium peroxodisulfate or the like; an azo compound such as 4,4'-azobis(4-cyanovaleric acid), 2,2'-azobis(2-methyl-N-(2-hydroxyethyl)propionamide, 2,2'-azobis(2-amidinopropane) dihydrochloride, 2,2'-azobis(2,4-dimethylvaleronitrile), 2,2'-azobisisobutyronitrile or the like; peroxide such as di-t-butylperoxide, benzoylperoxide, t-butylperoxy-2-ethylhexanoate, t-hexylperoxy-2-ethylhexanoate, t-butylperoxypyvalate, diisopropylperoxydicarbonate, di-t-butylperoxyisophthalate, t-butylperoxyisobutyrate or the like. Also, a redox initiator which is a combination of the polymerization initiator and a reducing agent may be used. Among the above, peroxide may be preferably used since an amount of a residual polymerizable monomer in a polymerized toner can be decreased and further printing durability is excellent.

After the polymerizable monomer composition is dispersed in the aqueous medium and before forming droplets, the polymerization initiator may be added as mentioned above, but also the polymerization initiator may be added to the polymerizable monomer composition before being dispersed in the aqueous medium.

An added amount of the polymerization initiator used for polymerization of the polymerizable monomer composition may be preferably 0.1 to 20 parts by weight with respect to a monovinyl monomer of 100 parts by weight, more preferably 0.3 to 15 parts by weight, most preferably 1.0 to 10 parts by weight.

(3) Polymerization

The forming droplets is performed as aforementioned, and then the aqueous medium containing the droplets of polymerizable monomer composition is heated to initiate polymerization, thereby a colored polymer particle is obtained.

Polymerization temperature of the polymerizable monomer composition may be preferably 50° C. or more, more preferably 60 to 95° C. Also, polymerization reaction time may be preferably 1 to 20 hours, more preferably 2 to 15 hours.

The colored polymer particle may be used as it is as a polymerized toner or as a polymerized toner by adding an external additive. Also, it is preferable to form a so-called core-shell type (or "capsule type") colored polymer particle, which can be obtained by using the colored polymer particle as a core layer and forming a shell layer, a material of which is different from that of the core layer, around the core layer. The core-shell type colored polymer particle can take a balance of excellent fixing ability (lowering of fixing temperature) and storability (prevention of blocking at storage of a toner) by covering the core layer comprising a substance having a low-softening point with a substance having a high softening point.

A method for producing the core-shell type colored polymer particle using the colored polymer particle may not be particularly limited, and may be produced by a conventional method. An in situ polymerization method and a phase separation method are preferable from the viewpoints of manufacturing efficiency.

In the in situ polymerization method, the core-shell type colored polymer particle can be obtained by adding a polymerizable monomer composition comprising a polymerizable monomer for forming a shell layer (polymerizable monomer for shell) as a main component and the polymerization initiator in the aqueous medium having the colored polymer particle dispersed followed by polymerization.

As the polymerizable monomer for shell, the same polymerizable monomer as aforementioned can be used. Among them, it is preferable to used the monomer which can provide a polymer having Tg of 80° C. or more such as styrene, acrylonitrile, methylmethacrylate or the like alone or in combination of two or more kinds.

As the polymerization initiator for shell used for polymerization of the polymerizable monomer for shell, there may be a water-soluble polymerization initiator such as a metal persulfate including potassium persulfate, ammonium persulfate or the like; a water-soluble azo compound including 2,2'-azobis(2-methyl-N-(2-hydroxyethyl)propionamide), 2,2'-azobis-(2-methyl-N-(1,1-bis(hydroxymethyl)2-hydroxyethyl)propionamide) or the like. An amount of the polymerization initiator for shell may be preferably 0.1 to 30 parts by weight with respect to a polymerizable monomer for shell of 100 parts by weight, more preferably 1 to 20 parts by weight.

Polymerization temperature of the shell layer may be preferably 50° C. or more, more preferably 60 to 95° C. Also, a reaction time of polymerization may be preferably for 1 to 20 hours, more preferably for 2 to 15 hours.

(4) Filtering, Washing, Dewatering and Drying

The aquesous dispersion of colored polymer particle obtained by polymerization is preferably subject to filtering, washing (removal of dispersion stabilizer), dewatering and drying for several times, if necessary, in conventional manner after polymerization.

As a method for washing mentioned above, if an inorganic compound such as metal hydroxide or the like is used as the dispersion stabilizer, it is preferable to add acid or alkali to the aqueous dispersion of a colored polymer particle so as to dissolve the dispersion stabilizer in water and remove. If colloid of hardly water-soluble inorganic hydroxide is used as the dispersion stabilizer, it is preferable to add acid so as to adjust pH of the aqueous dispersion of a colored polymer particle to 6.5 or less. As acid to be added, there may be inorganic acid such as sulfuric acid, hydrochloric acid, nitric acid or the like, and organic acid such as formic acid, acetic acid or the like. Inorganic acid is suitable, particularly sulfuric acid, as removing efficiency is high and adverse affect on production facilities is small.

As a method of dewatering and filtering, various known methods or the like can be used and may not be particularly limited. For example, there may be centrifugal filtration, vacuum filtration, pressure filtration or the like. A method of drying may not be particularly limited, and various methods can be used.

A colored polymer particle or a core-shell type colored polymer particle comprising a polymerized toner of the present invention will be explained (hereinafter, a colored polymer particle includes both core-shell type colored polymer particle and colored polymer particle which is not a core-shell type).

A volume average particle diameter Dv of the colored polymer particle may be preferably 3 to 15 μm, more preferably 4 to 12 μm. If Dv is less than the above range, a flowability of the polymerized toner lowers, transferability may deteriorate, blur may generate in an image to be obtained, or printing density may lower. To the contrary, if Dv exceeds the above range, resolution of an image may decline.

A ratio Dv/Dp of a volume average particle diameter Dv and a number average particle size Dp, representing distribution of particle size of the colored polymer particle comprising the polymerized toner of the present invention may be preferably 1.0 to 1.3, more preferably 1.0 to 1.2. If Dv/Dp exceeds the above range, transferability of a toner may decrease, blur may generate in an image to be obtained, and printing density and resolution may decline. Dv and Dp of the colored polymer particle may be measured, for example, by means of a particle diameter distribution measuring device (trade name: multicizer; manufactured by Beckman Coulter, Inc.) or the like.

A spheroidicity Sc/Sr of the colored polymer particle comprising the polymerized toner of the present invention is preferably 1.0 to 1.3, more preferably 1.0 to 1.2. If the spheroidicity Sc/Sr is over the above range, transferability may decline, the flowability of the toner may lower, blur may easily generate, or transferability may be deteriorated to decline dot reproducibility. The spheroidicity Sc/Sr of a colored polymer particle can be obtained as follows. The colored polymer particle is photographed by means of an electron microscope, and thus obtained microgram is measured by means of an image analyzer (trade name: LUZEX IID; manufactured by Nireco Corporation) under the condition that maximum area ratio of particle with respect to frame area is 2% and a total process number of particle is 100. The spheroidicity of the colored polymer particle can be obtained by averaging the spheroidicity Sc/Sr of the obtained 100 colored polymer particles.

Sc: an area of a circle supposing that the absolute maximum length of colored polymer particles is a diameter Sr: a substantial projected area of the colored polymer particle (5) Polymerized Toner As a polymerized toner, the colored polymer particle may be used as it is for developing electrophotography. Also, the colored polymer particle, an external additive and other particles may be mixed by means of a high-speed agitator such as a Henshcel mixer or the like to form a one-component polymerized toner in order to control charge property of a polymerized toner, flowability, storability or the like. Further, in addition to the colored polymer particle, the external additive and other particles, if required, a carrier particle such as ferrite, iron powder or the like may be mixed by various known methods to form a two-component polymerized toner. In the present invention, it is more preferable to form a one-component polymerized toner.

As the external additive, generally, there may be an inorganic particle and an organic resin particle used for the purpose of improving fluidity and charge property of a toner, and a particle having smaller particle size than the colored polymer particle may be used. For example, as the inorganic particle, there may be a particle of silica, aluminum oxide, titanium oxide, zinc oxide, tin oxide, calcium carbonate, calcium phosphate, cerium oxide or the like. As the organic resin particle, there may be a particle of a methacrylate polymer, an acrylate polymer, a styrene-methacrylate copolymer, a styrene-acrylate copolymer, a melamine resin or the like, or a core-shell type particle, the core of which is a styrene polymer and the shell of which is a methacrylate polymer, or the like. Among the above, the particle of silica and the particle of titanium oxide may be preferable, a particle of silica or titanium, the surface of which is subjected to a hydrophobicity-imparting treatment may be more preferable, a particle of silica or titanium which is subjected to a hydrophobicity-imparting treatment is most preferable. It is particularly preferable to use two or more kinds of silica which are subjected to a hydrophobicity-imparting treatment together. An added amount of the external additive may be generally 0.1 to 6 parts by weight with respect to 100 parts by weight of a colored polymer particle.

The polymerized toner of the present invention has a melt index value at 150° C. under load of 98 N (10 kgf) is 1 g/10 min or more and 30 g/10 min or less, preferably 2 g/10 min or more and 20 g/10 min or less. By forming a polymerized toner in the above range, toner leakage is not easily occurred while maintaining excellent low-temperature fixing ability. This is because the polymerized toner is not easily adhered to a sealing member furnished between both ends of a developing roller in an axial direction and a body of a developing cartridge.

EXAMPLES

The present invention will be explained further in detail with reference to examples. However, the present invention may not be limited to the following examples. Also, "part(s)" and "%" are based on weight if not particularly mentioned.

Testing methods in examples of the present invention are as follows.

(1) Maximum Endothermic Peak Temperature

A temperature which shows a maximum endothermic peak (maximum endothermic peak temperature) of an ester compound was measured with reference to ASTM D3418-82. More specifically, by means of Differential Scanning Calorimetry (DSC) (product name: SSC5200; manufactured by Seiko Instruments Inc.), a sample was heated to raise temperature at a heating rate of 10° C./min, and a temperature which shows a maximum endothermic peak of the DSC curve obtained in the process was measured.

(2) Melt Index Value

In the present invention, a melt index value of a polymerized toner was measured by means of Melt Indexer (trade name: semi-auto Melt Indexer; manufactured by Toyo Seiki Seisaku-sho, Ltd.) with reference to "Method A" of JIS (Japanese Industrial standards) K7210 at 150° C. under load of 98 N (10 kgf).

(3) Printing Test (Generation of Fogging)

A commercially available printer (printing speed: 18 prints per minute) of a non-magnetic one-component developing method was used for a printing test. A polymerized toner for testing was charged into a developing apparatus of the printer. After leaving the printer at 23° C. in humidity of 50% for one day, 14,000 prints were continuously printed with 1% printing density and fogging was measured every 500 prints. Herein, the fogging is expressed as fogging value calculated as follows. The whiteness "B" of a paper which was subject to white solid printing was measured by means of a whiteness meter (manufactured by NIPPON DENSHOKU CO., LTD.). Similarly, as a reference, the whiteness "A" of an unused paper was measured. The difference between the whiteness's "A" and "B" (A-B) was referred to as a fogging value. Smaller fogging value means less in fogging and better in printing. A printed number of printed sheets when the fogging value exceeded 2 was referred to as the number of prints generating fogging.

(4) Printing Test (Generation of Filming)

Similarly as the above-mentioned (3), 14,000 prints were continuously printed. A photoconductor was visually observed every 500 prints to inspect the presence or absence of filming. A printed number of printed sheets when the filming was confirmed was referred to as the number of printed sheets generating filming.

(5) Printing Test (Toner Leakage)

Similarly as the above-mentioned (3), 14,000 prints were continuously printed. A sealing member between both ends of a developing roller in an axial direction and a body of a developing cartridge was observed every 500 prints to inspect the presence or absence of toner leakage. A printed number of printed sheets when the toner leakage was confirmed was referred to as the number of printed sheets generating toner leakage.

(6) Printing Test (Minimum Fixing Temperature)

A printer modified so that the temperature of a fixing roll of the printer can be changed was used for a fixing test. In the fixing test, while changing temperature of the fixing roll of the printer, the fixing rate of the polymerized toner was measured at each temperature.

The fixing rate was calculated from the rate of image density before and after a tape peeling operation of a black solid area printed on a paper. That is, when an image density before the tape peeling operation was "ID (before)" and an image density after the tape peeling operation was "ID (after)", the fixing rate can be calculated from the following formula:

$$\text{Fixing rate (\%)}=(\text{ID (after)}/\text{ID (before)})\times 100$$

Herein, the tape peeling operation is an operation to stick an adhesive tape (product name: scotch mending tape 810-3-18; manufactured by Sumitomo 3M Limited) on a measuring part (a black solid area) of a paper followed by pressing at a constant pressure to attach, and to peel the adhesive tape to the direction along the paper at a constant speed. The image density was measured by means of a reflection type image density meter (manufactured by McBeth CO., LTD.). In the fixing test, the lowest fixing roll temperature when the fixing rate was 90% or more was referred to as a minimum fixing temperature of a polymerized toner.

Example 1

As a monovinyl monomer, 83 parts of styrene and 17 parts of n-butyl acrylate (calculated Tg of copolymer to be obtained=60° C.), 7 parts of carbon black (trade name: #25B; manufactured by Mitsubishi Chemical Corporation) as a colorant, 6 parts of dipentaerythritol hexamyristate (maximum endothermic peak temperature of 66.2° C., molecular weight of 1,514) as a release agent, 0.8 parts of a charge control agent (trade name : FCA-207P (charge control resin); manufactured by FUJIKURAKASEI CO., LTD.), 0.9 parts of divinyl benzene, 1.9 parts of t-dodecyl mercaptan, 0.25 parts of a polymethacrylic acid ester macromonomer (trade name: AA6; manufactured by TOAGOSEI CO., LTD., Tg=94° C.) were uniformly dispersed by means of a dispersing machine, thus obtained a polymerizable monomer composition.

Separately, an aqueous solution of 4.8 parts sodium hydroxide dissolved in 50 parts of ion-exchanged water was gradually added into an aqueous solution of 8.6 parts magnesium chloride dissolved in 250 parts of ion-exchanged water while agitating at room temperature. Thereby, a magnesium hydroxide colloid (dispersion stabilizer) dispersion liquid was prepared.

The polymerizable monomer composition was charged into thus obtained magnesium hydroxide colloid dispersion liquid and agitated. Thereto, as a polymerization initiator, 5 parts of t-butylperoxy-2-ethylhexanoate (trade name: "PERBUTYL O"; manufactured by Nihon Yushi Co., Ltd.) was added. Thereafter, a high shear stirring was performed at 15,000 rpm for 10 minutes by means of an in-line type emulsifying and dispersing machine (trade name: Ebara MILDER; manufactured by Ebara Corporation) to form droplets of the polymerizable monomer composition, thus obtained an aqueous dispersion of the polymerizable monomer composition.

The aqueous dispersion of the droplets of polymerizable monomer composition was charged into a reactor. A polymerization reaction was performed by raising temperature of the reactor to 90° C. When polymerization conversion rate reached 95%, 0.7 parts of methyl methacrylate as a polymerizable monomer for shell and 0.07 parts of 2,2'-azobis(2-methyl-N-(2-hydroxyethyl)-propionamide (trade name: VA086; manufactured by Wako Pure Chemical Industries, Ltd.) (polymerization initiator for shell) dissolved in 7 parts of ion-exchanged water were added. Polymerization was further continued for 3 hours followed by cooling to room temperature, thus obtained an aqueous dispersion of a colored polymer particle having pH 9.5.

The aqueous dispersion of the colored polymer particle was subject to acid washing in which pH is added to be 6.5 or less by sulfuric acid. After dewatering by filtrating, ion-exchanged water was added again by 500 parts to make a slurry followed by washing with water. Thereafter, similarly, dewatering and washing with water was repeated for several times. After dewatering by filtrating, vacuum drying was performed in a vacuum drying machine at 45° C. under pressure of 30 torr for one day, thus obtained a dried colored polymer particle.

The volume average particle diameter of the dried colored polymer particle was 9.5 μm and Dv/Dp was 1.16. Further, the spheroidicity Sc/Sr was 1.20.

As external additives, 0.8 parts of a silica particle subjected to a hydrophobicity-imparting treatment (a primary particle diameter of 7 mm) and 1.0 parts of a silica particle subjected to a hydrophobicity-imparting treatment (a primary particle diameter of 30 mm) were added to 100 parts of thus obtained colored polymer particle, and mixed by means of a Henschel mixer, thereby, a non-magnetic one-component polymerized toner was prepared.

Example 2

In the same manner as Example 1 except that an added amount of divinylbenzene was 0.8 parts, a polymerized toner was prepared. The test results are shown in Table 1.

Example 3

In the same manner as Example 1 except that the monovinyl monomer was changed to 81 parts of styrene and 19 parts of n-butyl acrylate (calculated Tg of a copolymer to be obtained=56° C.), a polymerized toner was prepared. The test results are shown in Table 1.

Example 4

In the same manner as Example 1 except that the added amount of dipentaerythritol hexamyristate (release agent) was changed from 6 parts to 3 parts, a polymerized toner was prepared. The test results are shown in Table 1.

Example 5

In the same manner as Example 3 except that the added amount of divinylbenzene was 0.7 parts, a polymerized toner was prepared. The test results are shown in Table 1.

Example 6

In the same manner as Example 2 except that the release agent was changed to pentaerythritol tetrastearate (maximum endothermic peak temperature of 75.9° C., molecular weight of 1,200), a polymerized toner was prepared. The test results are shown in Table 1.

Example 7

In the same manner as Example 6 except that the added amount of divinylbenzene was 0.7 parts, a polymerized toner was prepared. The test results are shown in Table 1.

Comparative Example 1

In the same manner as Example 2 except that the added amount of dipentaerythritol hexamyristate (release agent) was changed from 6 parts to 0.5 parts, a polymerized toner was prepared. The test results are shown in Table 1.

Comparative Example 2

In the same manner as Comparative example 1 except that the added amount of divinylbenzene was 0.7 parts, a polymerized toner was prepared. The test results are shown in Table 1.

Comparative Example 3

In the same manner as Example 1 except that the added amount of dipentaerythritol hexamyristate (release agent) was 8 parts and the added amount of divinylbenzene was 1.0 part, a polymerized toner was prepared. The test results are shown in Table 1.

Comparative Example 4

In the same manner as Comparative example 3 except that the added amount of divinylbenzene was 0.7 parts, a polymerized toner was prepared. The test results are shown in Table 1.

Comparative Example 5

In the same manner as Comparative example 3 except that the added amount of divinylbenzene was 0.6 parts, a polymerized toner was prepared. The test results are shown in Table 1.

Comparative Example 6

In the same manner as Comparative example 1 except that the added amount of dipentaerythritol hexamyristate (release agent) was changed to 15 parts, a polymerized toner was prepared. The test results are shown in Table 1.

Comparative Example 7

In the same manner as Comparative example 1 except that the added amount of dipentaerythritol hexamyristate (release agent) was changed to 20 parts, a polymerized toner was prepared. The test results are shown in Table 1.

Comparative Example 8

In the same manner as Comparative example 1 except that the release agent was changed to 8 parts of cetyl myristate (maximum endothermic peak temperature of 48.3° C., molecular weight of 428), a polymerized toner was prepared. The test results are shown in Table 1.

Comparative Example 9

In the same manner as Comparative example 2 except that the release agent was changed to 2 parts of paraffin wax (trade name: FT-100; manufactured by Shell MDS CO., LTD.) (maximum endothermic peak temperature of 99.0° C.), a polymerized toner was prepared. The test results are shown in Table 1.

Comparative Example 10

80.5 parts of styrene and 19.5 parts of n-butyl acrylate (calculated Tg of a copolymer to be obtained=55° C.) as monovinyl monomers, colorant 6 parts of carbon black (trade name: #25; manufactured by Mitsubishi Chemical Corporation) as a colorant, 0.01 parts of a charge control agent (trade name: VONTRON N-01 (a nigrosine dye); manufactured by Orient Chemical Industries, Ltd.), 0.4 parts of divinylbenzene, 1.0 part of t-dodecylmercaptan, and 0.5 parts of a polymethacrylate ester macromonomer (trade name: AA6; manufactured by TOAGOSEI CO., LTD., Tg=94° C.) were uniformly dispersed by means of a dispersing machine. Thereto, as a release agent, 3 parts of pentaerythritol tetrabehenate (the amount dissolved=5 (g/100 g styrene) or less, maximum endothermic peak temperature of 81.0° C., molecular weight of 1,424), which is an ester compound, was mixed and dissolved, thus obtained a polymerizable monomer composition.

At room temperature, an aqueous solution of 4.8 parts of sodium hydroxide dissolved in 50 parts of ion-exchanged water was gradually added to an aqueous solution of 8.6 parts of magnesium chloride dissolved to 250 parts of ion-exchanged water while agitating. Thereby, magnesium hydroxide colloid (hardly water-soluble dispersion stabilizer) dispersion liquid was prepared.

At room temperature, the polymerizable monomer composition was charged into thus prepared magnesium hydroxide colloid dispersion liquid. Then, 5 parts of t-butylperoxyisobutyrate (trade name: PERBUTYL IB; manufactured by Nihon Yushi Co. Ltd.) was added as a polymerization initiator. Next, droplets of the polymerizable monomer composition were formed by means of an in-line type emulsifying and dispersing machine (trade name: Ebara MILDER; manufactured by Ebara Corporation) under a high shear agitation at 15,000 rpm for 10 minutes.

The obtained aqueous dispersion of the polymerizable monomer composition was charged into a reactor furnished with stirring vanes. A temperature of the reactor was raised to 95° C., and polymerization was performed. After polymerization reaction for 10 hours, the reactor was cooled with water to stop the polymerization reaction, thus obtained an aqueous dispersion of a colored polymer particle. Thereafter, in the same operation as Example 1, a polymerized toner was obtained. A volume average particle diameter of the colored polymer particle was 9.9 μm and Dv/Dp was 1.35. A spheroidicity Sc/Sr was 1.28. The test results are shown in Table 1.

Comparative Example 11

As monovinyl monomers, 78 parts of styrene and 22 parts of n-butyl acrylate (calculated Tg of a copolymer to be obtained=50° C.), 7 parts of carbon black (trade name: Printex 150T; manufactured by Degussa Ltd.) as a colorant, 0.01 parts of a charge control agent (trade name: VONTRON N-01 (a nigrosine dye); manufactured by Orient Chemical Industries, Ltd.); 0.3 parts of divinylbenzene; 0.8 parts of polymethacrylate ester macromonomer (trade name: AA6; manufactured by TOAGOSEI CO., LTD.), 5 parts of pentaerythritol tetrastearate (the amount dissolved=10 (g/100 g styrene) or more, maximum endothermic peak temperature of 75.9° C., molecular weight of 1,200) as a release agent; 4 parts of t-butylperoxy-2-ethylhexanoate (trade name: PERBUTYL O; manufactured by Nihon Yushi Co. Ltd.) was stirred and mixed at 12,000 rpm by means of a high shear stirrer (trade name: TK type homomixer; manufactured by TOKUSHUKIKA KOGYO CO., LTD.) to uniformly disperse, thus obtained a polymerizable monomer composition.

Separately, an aquesous solution of 4.8 parts of sodium hydroxide dissolved in 50 parts of ion-exchanged water was added gradually to an aqueous water of 8.6 parts of magnesium chloride dissolved in 250 parts of ion-exchanged water while stirring at room temperature, thereby, magnesium hydroxide colloid (hardly water-soluble metal hydroxide colloid) dispersion liquid was prepared.

The polymerizable monomer composition was charged into thus obtained magnesium hydroxide colloid dispersion liquid and agitated. Thereafter, the polymerizable monomer composition was subject to forming droplets of the polymerizable monomer composition by means of an in-line type emulsifying and dispersing machine (trade name: Ebara MILDER; manufactured by Ebara Corporation) under a high shear agitation at 15,000 rpm for 10 minutes, thus obtained an aqueous dispersion of the polymerizable monomer composition.

The obtained aqueous dispersion of the polymerizable monomer composition was charged into a reactor. A polymerization reaction was performed by raising temperature of the reactor to 90° C. When polymerization conversion rate reached 95%, 10 parts of methyl methacrylate as a polymerizable monomer for shell and 0.01 parts of potassium peroxodisulfate (polymerization initiator for shell) dissolved in 1 parts of ion-exchanged water were added to the reactor. Polymerization for was further continued for 5 hours followed by cooling to room temperature, thus obtained an aqueous dispersion of a colored polymer particle having pH 9.5. Thereafter, the same operation as that of Example 1 was performed, thus obtained a polymerized toner. A volume average particle diameter of the colored polymer particle was 9.6 μm, and Dv/Dp was 1.26. A spheroidicity Sc/Sr was 1.29. The test results are shown in Table 1.

TABLE 1

| | Kind of release agent | Maximum endothermic peak temperature of release agent(° C.) | Added amount of release agent (parts by weight) | Melt index value of toner (g/10 min) | Number of sheets generating fogging (sheets) | Number of sheets generating filming (sheets) | Number of sheets generating toner leakage (sheets) | Minimum fixing temperature (° C.) |
|---|---|---|---|---|---|---|---|---|
| Example 1 | A | 66.2 | 6 | 5 | 14,000 | 14,000 | 14,000 | 190 |
| Example 2 | A | 66.2 | 6 | 10 | 14,000 | 14,000 | 14,000 | 190 |
| Example 3 | A | 66.2 | 6 | 12 | 14,000 | 14,000 | 14,000 | 190 |
| Example 4 | A | 66.2 | 3 | 3 | 14,000 | 14,000 | 14,000 | 190 |
| Example 5 | A | 66.2 | 6 | 19 | 14,000 | 14,000 | 14,000 | 180 |
| Example 6 | B | 75.9 | 6 | 6 | 14,000 | 14,000 | 14,000 | 190 |
| Example 7 | B | 75.9 | 6 | 15 | 14,000 | 14,000 | 14,000 | 190 |
| Comparative example 1 | A | 66.2 | 0.5 | 4 | 14,000 | 14,000 | 14,000 | 220 |
| Comparative example 2 | A | 66.2 | 0.5 | 35 | 14,000 | 13,000 | 13,000 | 210 |
| Comparative example 3 | A | 66.2 | 8 | 0.4 | 14,000 | 14,000 | 14,000 | 220 |
| Comparative example 4 | A | 66.2 | 8 | 32 | 14,000 | 12,000 | 11,000 | 200 |
| Comparative example 5 | A | 66.2 | 8 | 51 | 14,000 | 7,000 | 8,000 | 180 |
| Comparative example 6 | A | 66.2 | 15 | 25 | 14,000 | 4,000 | 5,000 | 170 |
| Comparative example 7 | A | 66.2 | 20 | 51 | 14,000 | 2,500 | 3,000 | 170 |
| Comparative example 8 | C | 48.3 | 8 | 21 | 2,500 | 3,000 | 4,000 | 170 |

TABLE 1-continued

| | Kind of release agent | Maximum endothermic peak temperature of release agent(° C.) | Added amount of release agent (parts by weight) | Melt index value of toner (g/10 min) | Number of sheets generating fogging (sheets) | Number of sheets generating filming (sheets) | Number of sheets generating toner leakage (sheets) | Minimum fixing temperature (° C.) |
|---|---|---|---|---|---|---|---|---|
| Comparative example 9 | D | 99.0 | 2 | 8 | 14,000 | 14,000 | 14,000 | 220 |
| Comparative example 10 | E | 81.0 | 3 | 32 | 14,000 | 14,000 | 14,000 | 220 |
| Comparative example 11 | B | 75.9 | 5 | 36 | 14,000 | 11,000 | 12,000 | 180 |

<Kind of release agent>
A: dipentaerythritol hexamyristate
B: pentaerythritol tetrastearate
C: cetylmyristate
D: paraffin wax
E: pentaerythritol tetrabehenate The test results shown in Table 1 can be analyzed as follows.

The polymerized toners having larger added amount of an ester compound as a release agent than the range of amount defined in the present invention, having lower maximum endothermic peak temperature than the range of maximum endothermic peak temperature defined in the present invention, or having larger melt index value at 150° C. under load of 98 N (10 kgf) than the range of melt index value defined in the present invention easily cause toner leakage and filming. To the contrary, the polymerized toner having small added amount of ester compound as a release agent, or having higher maximum endothermic peak temperature than the defined range has a problem with low-temperature fixing ability.

However, the polymerized toners of Examples 1 to 7 of the present invention have low-temperature fixing ability, do not cause fogging or filming even after printing continuously, and do not easily cause toner leakage from a developing cartridge.

The polymerized toner produced in the present invention may be used for a developer of copying machines, facsimile machines, printers or the like using electrophotography.

What is claimed is:

1. A polymerized toner produced by polymerizing a polymerizable monomer composition comprising a polymerizable monomer, a colorant and a release agent in an aqueous medium, in which the toner is used as a core layer and a shell layer is formed around the core layer by covering the core layer, the core layer comprising a substance having a low-softening point and the shell layer comprising a substance having a high-softening point, wherein the polymerizable monomer comprises a crosslinkable polymerizable monomer in an amount of from 0.1 part by weight to 5 parts by weight per 100 parts by weight of a monovinyl monomer in the polymerizable monomer, and wherein:

(1) the release agent is an ester compound;

(2) the release agent is in the content from 1 part by weight or more to 9 parts by weight or less per 100 parts by weight of a monovinyl monomer in the polymerizable monomer;

(3) a maximum endothermic peak temperature in a DSC curve of the release agent is in the range from 55° C. or more to 90° C. or less; and (4) a melt index value of the polymerized toner at 150° C. under load of 98 N (10 kgf) is in the range from 1 g/10 min or more to 30 g/10 min or less.

2. The polymerized toner according to claim 1, wherein a molecular weight of the ester compound is 500 or more and 1,900 or less.

3. The polymerized toner according to claim 1, wherein the ester compound is ester of alcohol of trivalent or more and fatty acid having carbons in the number from 12 or more to 22 or less.

4. The polymerized toner according to claim 1, wherein the monovinyl monomer is at least one compound selected from a group consisting of styrene, a styrene derivative, acrylic acid ester and methacrylic acid ester.

5. The polymerized toner according to claim 1, wherein a volume average particle diameter (Dv) representing particle distribution of said polymerized toner is 3 to 15 μm.

6. The polymerized toner according to claim 1, wherein a ratio Dv/Dp of a volume average particle diameter (Dv representing particle distribution of said polymerized toner and Dp representing a number average particle size) is 1.0 to 1.3.

* * * * *